United States Patent [19]

Scolari et al.

[11] Patent Number: 4,623,824

[45] Date of Patent: Nov. 18, 1986

[54] CONTROLLED HIGH VOLTAGE GENERATOR

[75] Inventors: John E. Scolari, La Mesa; Robert T. Warner, Poway; Joe E. Deavenport, San Diego, all of Calif.

[73] Assignee: Life Light Systems, San Diego, Calif.

[21] Appl. No.: 618,055

[22] Filed: Jun. 7, 1984

[51] Int. Cl.[4] ..... H05B 37/00; H05B 39/00; H05B 41/14

[52] U.S. Cl. ..... 315/241 R; 315/241 P; 315/232; 315/307; 323/242; 354/145.1; 446/401

[58] Field of Search ..... 315/241 R, 232, 200 A, 315/322, 241 P, 307; 363/19, 21, 61; 320/1; 446/405, 406, 401; 323/242, 243; 354/145.1

[56] References Cited

U.S. PATENT DOCUMENTS

| | | | |
|---|---|---|---|
| 3,316,445 | 4/1967 | Ahrons | 315/183 |
| 3,593,061 | 7/1971 | Takahata et al. | 315/241 R |
| 3,624,446 | 11/1971 | Goldberg | 315/241 R |
| 3,679,991 | 7/1972 | Wilwerding | 331/62 |
| 3,764,849 | 10/1973 | Ohta | 315/241 P |
| 3,777,212 | 12/1973 | Mashimo | 315/241 R X |
| 3,819,983 | 6/1974 | Bjork | 315/238 |
| 3,828,222 | 8/1974 | Mason | 315/241 P |
| 3,928,793 | 12/1975 | Waltz | 363/19 |
| 3,962,601 | 6/1976 | Wrzesinski | 315/241 R |
| 4,005,237 | 1/1977 | Rabe | 315/241 S |
| 4,075,536 | 2/1978 | Stevens | 315/241 R X |
| 4,185,232 | 1/1980 | Ingalls et al. | 315/241 R |
| 4,194,143 | 3/1980 | Farkas et al. | 315/241 R |
| 4,216,413 | 8/1980 | Plas | 315/241 R X |
| 4,321,507 | 3/1982 | Bosnak | 315/241 R |
| 4,365,439 | 12/1982 | Litynski | 446/406 |
| 4,430,602 | 2/1984 | Ohmori | 315/241 P |

OTHER PUBLICATIONS

"Buck Rogers Sonic Ray 25th Century Signal Light", *Playthings*, Mar. 1949, pp. 353–354, 600.

*Primary Examiner*—Saxfield Chatmon
*Attorney, Agent, or Firm*—Baker, Maxham & Jester

[57] ABSTRACT

A highly efficient circuit for converting a low level DC voltage to the high voltage necessary for energizing a flash lamp. The circuit is very small and non-complex, it is portable and is quickly recharged, particularly being adaptable for emergency flash uses and for toys such as light swords and laser pistols. A very efficient portion of the circuit, comprising a DC/AC inverter, an AC/DC converter and a voltage multiplier, operating at an appropriate frequency, enables the flash capacitor to always be maintained substantially at peak voltage value with minimum power usage.

26 Claims, 6 Drawing Figures

450v
0
t0
350v
0
t0
11
12
13
15
16
21
24
25
73
99
101
102
103
104
105
106
107
108
109
110
111
112
113
114
115
116
117
118
119
120
121
Vcc
0

CONTROLLED HIGH VOLTAGE GENERATOR

FIELD OF THE INVENTION

This invention relates generally to high voltage flash circuits and more particularly concerns a simple circuit for efficiently converting low voltage DC to high voltage DC.

BACKGROUND OF THE INVENTION

A number of power supplies have been proposed for electronic flash purposes where the circuit, operating from a power source, functions with means for charging and discharging a capacitor for operating a flash lamp. Typically, many of the systems have had means of some type for sensing the capacitor voltage and disabling the charging circuit after the capacitor has been fully charged, to save power.

The prior art systems mentioned above generally have limitations which make them not suitable for use with toy weapons which require an immediate bright flash in response to trigger actuation, rapid recharging to afford as much realism as possible for children playing with such toys, and relative light weight. These prior systems typically have a relatively long charging time, betwen 6 and 30 seconds, or have relatively large sources of power, such as large or bulky batteries, or are connected to an AC source and are thereby non-portable. Also these systems, in order to achieve the desired results, are frequently quite complex as well as being too large to be employed in a children's toy. Another problem with many prior art systems is that the voltage sensing mechanism is not precise so there is a relatively large swing between full charge of the flash capacitor and the voltage level at which the charge again builds up. They often use a linear technology or a flyback transformer in the feedback circuit.

SUMMARY OF THE INVENTION

Broadly speaking, this invention relates to a controlled high voltage generator with a rapid charge rate operating at high efficiency while using a low voltage DC power source.

The circuit of this invention employs an oscillator to drive a DC/AC inverter connected to a low voltage DC power supply, such as a battery, to switch the power supply on and off at the desired frequency. The inverter also boosts the voltage by a factor of 10 to 15 and then a rectifier and voltage multiplier convert the signal to a high level DC voltage which is applied to a storage capacitor. A feedback circuit senses the output of the voltage multiplier and applies that voltage to a Schmitt trigger comparator, the output of which controls the operation of the oscillator.

The efficiency and low power loss aspects of the circuit and its components help make this voltage generator particularly adaptable for small toys where a rapid recharging rate is necessary, and for portable emergency flash units.

BRIEF DESCRIPTION OF THE DRAWING

The objects, advantages and features of this invention will be more readily appreciated from the following detailed description when read in conjunction with the accompanying drawing in which.

DESCRIPTION OF THE PREFERRED EMBODIMENTS

Figure 1:
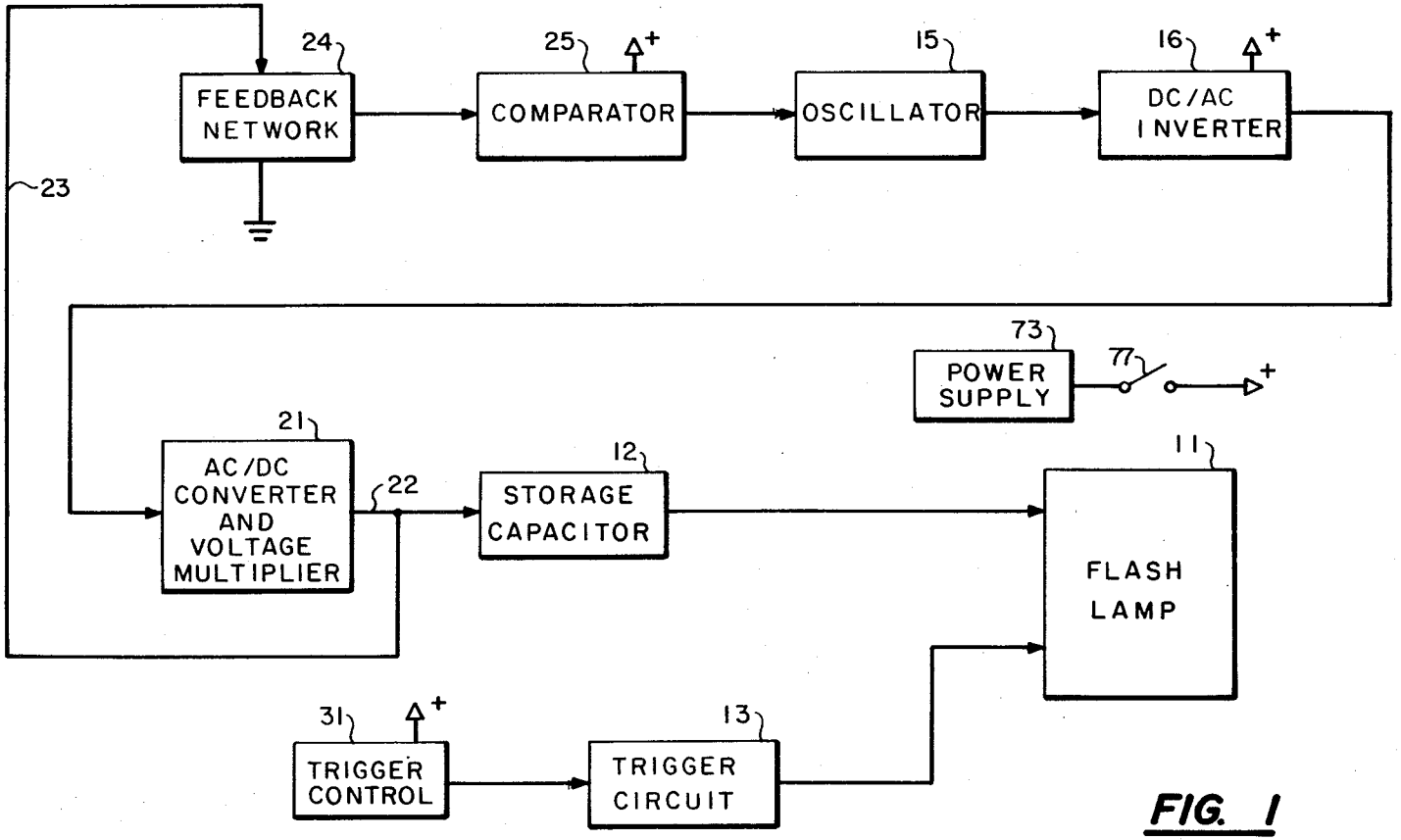
FIG. 1 is a block diagram of the basic controlled high voltage generator of the invention.

With reference now to the drawing, and particularly with respect to FIG. 1, there is shown a generalized block diagram of the controlled high voltage generator of this invention. Flash lamp 11 has a high voltage, approximately 450 volts, applied to it from storage capacitor 12. The lamp flashes upon actuation by a signal from trigger circuit 13 which discharges the storage capacitor across the flash lamp causing a substantially instantaneous bright flash. The trigger circuit is actuated by a signal from trigger control 31.

A control signal is applied to the input of oscillator 15 which operates at an appropriate frequency, in the range of 20 to 200 KHz, preferably about 25 KHz. A low DC voltage is applied to terminal 17 of DC/AC inverter 16 and, in conjunction with the switching engendered by oscillator 15, the inverter has a substantially amplified AC voltage output, approximately 10 to 15 times its input voltage. The AC output is applied to AC/DC converter/multiplier 21 where the voltage is rectified and multiplied to approximately 450 volts at output 22. This voltage may range from 400 to 475 volts and is applied across storage capacitor 12 to fire the flash lamp when triggered. A feedback loop 23 couples the output of multiplier 21 with feedback network 24, the output of which is applied to comparator 25. When the voltage on storage capacitor 12 reaches the desired level, it is sensed by the feedback network and comparator, and the comparator switches to disable the oscillator. When the voltage on the storage capacitor has been reduced, at least by a predetermined value, either by leakage or by discharge, a lower voltage appearing in the feedback network causes the comparator to switch the oscillator to an oscillating condition and quickly recharge the storage capacitor.

Figure 2:
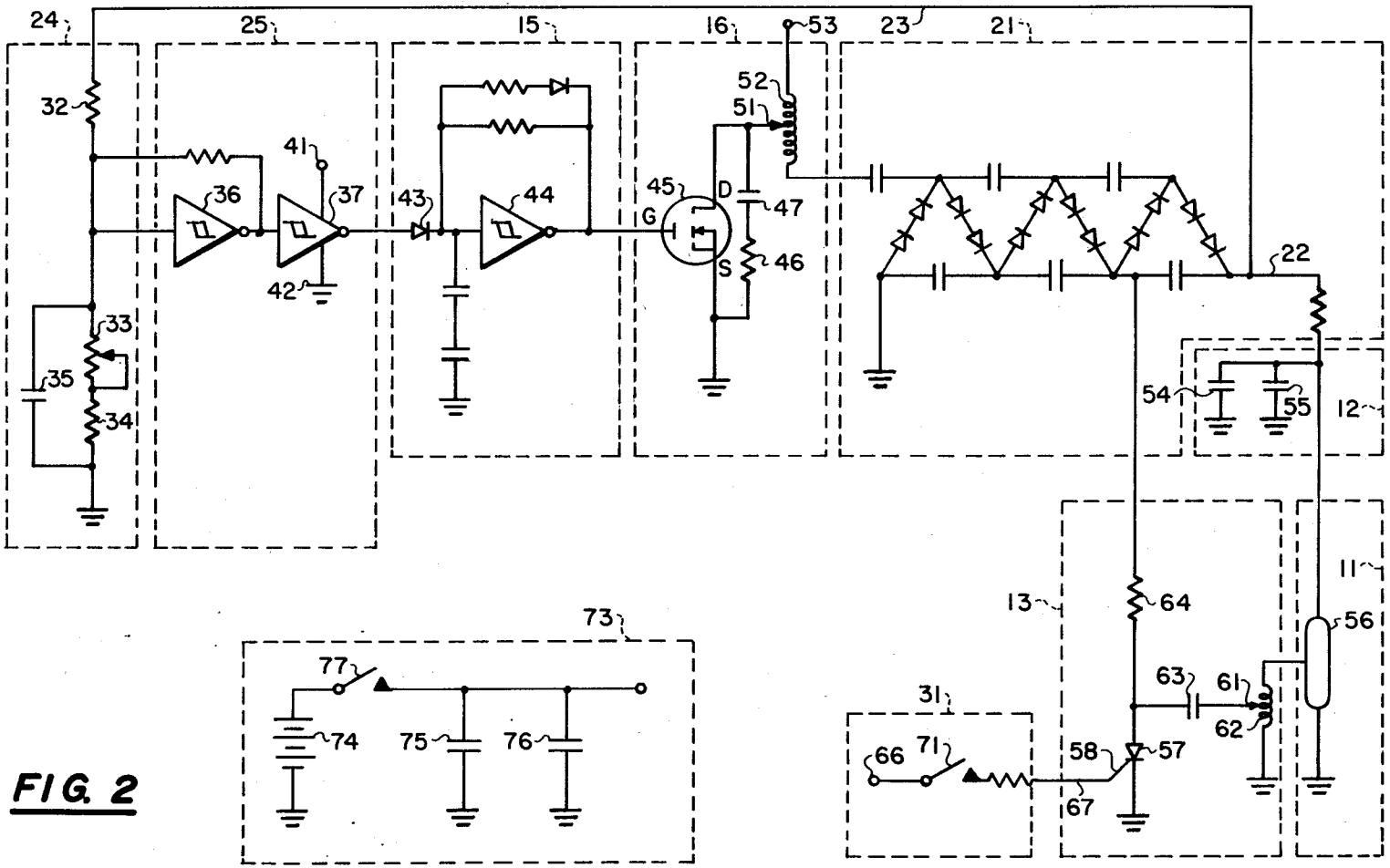
FIG. 2 is a generalized schematic diagram of the generator of FIG. 1.

The schematic diagram of FIG. 2 shows a basic example of the components in the blocks of FIG. 1. Feedback network 24 comprises a resistor 32 in series with a potentiometer 33 and another resistor 34. The potentiometer enables the level of voltage detected by the feedback network to be adjusted. Resistors 34 and potentiometer 33 are shunted by capacitor 35.

The feedback network is connected to comparator 25 comprised of Schmitt trigger elements 36 and 37. For convenience, element 37 is shown with a positive voltage input terminal 41 and a ground terminal 42. Actually, each such element in a single chip of many elements would have the positive and ground terminals. The output of the comparator is fed to diode 43 in oscillator 15, which also comprises a Schmitt trigger element 44. Elements 36, 37 and 44 are part of a single CMOS chip 40106 which is available from a number of different sources. The other diode, resistors and capacitors comprising the oscillator are common elements, typically arranged, and need not be described in detail here.

The output of the oscillator is applied to the gate terminal of field effect transistor (FET) 45, the D and S terminals of which are coupled across a series RC network comprising resistor 46 and capacitor 47. The D terminal of the FET and the RC network are connected to the tap 51 of coil 52. DC voltage from the power supply is applied to one end of coil 52 through terminal 53.

The output of the DC/AC inverter 16 is connected to the input of AC/DC convertor and voltage multiplier 21 which serves to rectify the medium level voltage AC signal out of the inverter and increase the voltage applied to storage capacitor 12 to approximately 450 volts. The storage capacitor is shown as being comprised of two capacitor elements 54 and 55 but this is a matter of design choice as to whether one or more capacitors are used. The charge stored in capacitor 12 is applied across tube 56 of flash lamp 11 and provides a bright flash when fired by means of trigger circuit 13 comprising silicon controlled rectifier (SCR) 57 connected through capacitor 63 to the tap 61 of coil 62. The capacitor is also connected through a resistor 64 back to AC/DC convertor and voltage multiplier 21. When SCR 57 conducts, the charge stored in storage capacitor 63 triggers flash lamp 56 into conduction through trigger coil 62 for an instantaneous brilliant flash.

Trigger circuit 13 is controlled by trigger control 31 comprising DC voltage input terminal 66 connected to lead 67 of SCR 57 through on/off switch 71.

Power supply 73, which powers the entire high voltage generator, comprises battery 74 shunted by capacitors 75 and 76 through normally closed enabling switch 77. Battery 74 may comprise more than one actual battery element, which would normally be connected in parallel. The B+ voltage, which is contemplated as being a simple 9-volt battery, is applied as indicated to comparator 25 and DC/AC inverter 16, as well as to trigger control circuit 31.

In operation, assuming storage capacitor 12 is fully charged, when on/off or trigger switch 71 is closed a positive voltage is applied to gate 58 of SCR 57 causing the SCR to immediately conduct causing the entire voltage on the storage capacitor to be applied across flash lamp 56, resulting in a bright flash of extremely short duration. This conduction is substantially instantaneous and the circuit then senses, through feedback loop 23 and circuit 24, that the voltage is a lower than desired full-charge level and will immediately trigger oscillator 15 into operation to recharge the capacitor. When the capacitor reaches the desired full charge, typically 450 volts, the feedback network 24 and comparator 25 sense that the desired voltage has been reached and disable the oscillator, thereby saving battery power. Due to leakage over a period of time, the charge on capacitor 12 may be reduced somewhat. This circuit can be adjusted to detect as little as four to six volts decrease in the charge in capacitor 12 and again through comparator 25 actuate oscillator 15 to bring the charge up to its full desired value.

The basic circuit of FIGS. 1 and 2 can be applied to several different devices with minor modifications. One circuit is used for toys such as pistols or light swords (FIG. 3), and a trigger function causes the storage capacitor to discharge through the flash lamp, the circuit operating to recharge the storage capacitor within about one second. A dual flash unit (FIG. 4) employs two of the circuits shown in FIG. 1 controlled by the trigger control circuitry to alternately flash two flash units such as for a car top emergency signal. Another modification is for a multiple sequential flash unit (FIG. 5) which operates generally as does the circuit of FIG. 1.

As indicated previously, there are some flash lamp devices which turn the charging circuit off when the storage capacitor is fully charged. Many of these systems allow the charge on the storage capacitor to be reduced by twenty to twenty-five volts before recharging occurs, due to several possible factors inherent in their circuitry. Because of the precision, simplicity and efficiency of the components and the circuits of the present invention, a charge reduction of four to six volts will be detected by the feedback network and comparator, resulting in recharging the storge capacitor. Frequent, small increment charging uses very little energy, much less than larger amounts of charging which occur less often. Another advantage of the present system is that the charge on the storage capacitor is always up to or near peak so there is no danger that the flash tube would be actuated at a low point, as much as five percent below peak, which could result in less than the desired brightness of flash.

Basically, the prior art devices having an intended similar function are typically much less precise than the present invention and some of them are very temperature sensitive so that the feedback voltage necessary to actuate the charging oscillator could vary greatly with temperature. This is especially true for those devices which depend on the leakage characteristics of a transistor to terminate the charging function. The feedback network and comparator of the present invention are extremely precise and efficient so that very little energy is used while at the same time the charge on the storage capacitor is maintained at the desired level with an extremely low variation. The switching technology used in this invention is very efficient and precise compared with linear technology or flyback transformers previously used.

Figure 3:
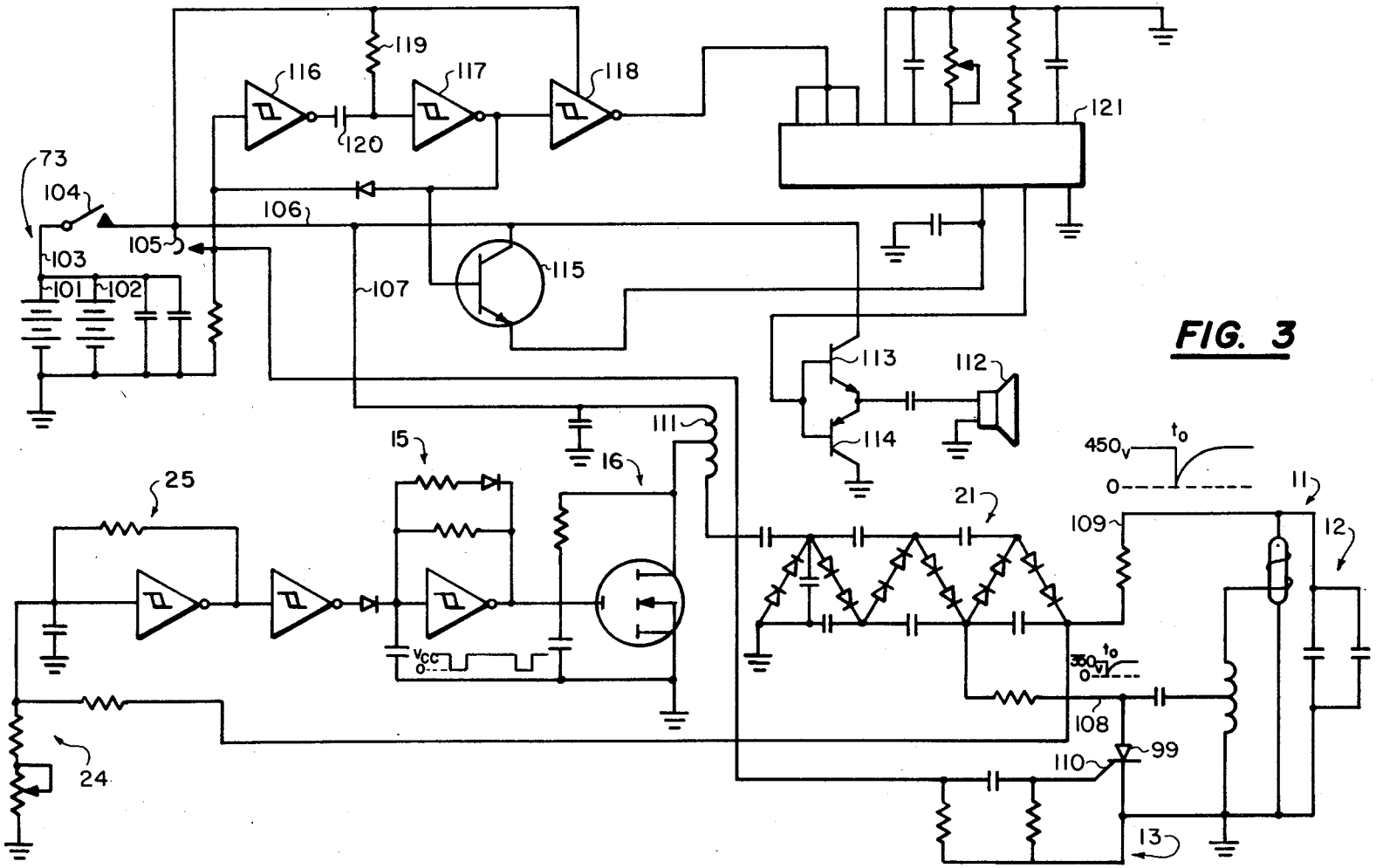
FIG. 3 is a schematic diagram of the generator of FIG. 1 configured for use in a toy sword or laser pistol.

With specific reference now to FIG. 3 there is shown a schematic of a circuit constructed in accordance with the principals of FIGS. 1 and 2, where this particular circuit is designed to be used on a toy laser gun or light sword. The peculiar requirements of such a toy is that the high intensity flash be available for immediate energization upon pulling a trigger or otherwise actuating the circuitry, and that it recharge quickly so that the toy can be repeatedly "fired". Additionally, the circuit of FIG. 3 includes a sound output which is an optional feature.

While the values of the components might differ to a certain extent, there is no substantial difference between the flash circuitry of FIG. 3 and the generalized form of FIG. 2. Storage capacitor 12 is connected across flash lamp 11 which is actuated by trigger circuit 13. The storage capacitor is charged through AC/DC converter and voltage multiplier circuit 21, the output of which is typically 450 volts DC. Oscillator 15 provides the switching necessary for operation of DC/AC inverter 16 and feedback and comparator circuits 24 and 25, respectively, function as previously described. The waveform out of the oscillator shows a square wave with a duty cycle having a 4:1 ratio. This is typical but not an absolute requirement. This enables the FET in inverter 16 to conduct 80% of the time, thus providing for very rapid charging of the storge capacitor. The 20% off time provides short periods to allow stored energy in the magnetic field to be transferred to the voltage multiplier. The inverter output would have a similar form but amplified to 100–150 volts.

The power supply 73 is comprised of two batteries 101 and 102 and the positive terminal 103 is connected to the trigger circuit through on/off or enabling switch 104 and trigger switch 105. For operation of the circuit, the on/off switch will be placed in an "on" position to provide charging of storage capacitor 12 by means of the connection from the on/off switch through wire 106 and wire 107 to the top portion of coil 111 in inverter 16.

For the sound circuit, speaker 112 is powered through an audio driver stage comprising two transistor 113 and 114 which are connected to transistor 115. A set of three Schmitt trigger elements 116, 117 and 118 are connected between power supply 73 and noise chip 121, one output of which is connected to the common bases of transistors 113 and 114. The noise chip is a conventional off the shelf item, one example of which is an SN9428. The chip establishes the character of the noise including frequency and other characteristics. The first two Schmitt trigger elements, 116 and 117, function as a monostable one shot multivibrator. The speaker generates the desired noise, powered by the power supply 73, for about one second. The time for the noise is governed by a timer circuit comprised of resistor 119 and capacitor 120 in the multivibrator. The output of Schmitt trigger element 118 is the actual trigger output, applied to the circuit represented by chip 121.

Each time the trigger switch 105 is closed after on/-off switch 104 has been closed, flash lamp 11 emits a short, bright flash and speaker 112 emits a burst of sound simultaneously with the flash. After the storage capacitor is charged a DC voltage of about 350 volts exists on line 108 and line 109 has a steady 450 volts applied to it. At the instant of closing trigger switch 105, the voltage from power supply 73 is applied to gate 110 of SCR 99, causing it to conduct and the lamp to flash. At that instant, time $t_o$, the voltage on both of lines 108 and 109 drops to zero, and then builds back quickly asymptotically to the normal values as shown by the associated waveforms. As soon as the flash tube fires, the feedback network and comparator function to commence operation of the oscillator, thereby recharging storge capacitor 12. This is normally accomplished within about one second, whereby the toy gun is then available for "firing" again with another brilliant flash.

Instead of a pistol shape laser gun, the circuit of FIG. 3 can be used in a light sword and it functions in the same manner. As indicated previously, the "realism" sound aspect of the circuit is optional.

Figure 4:
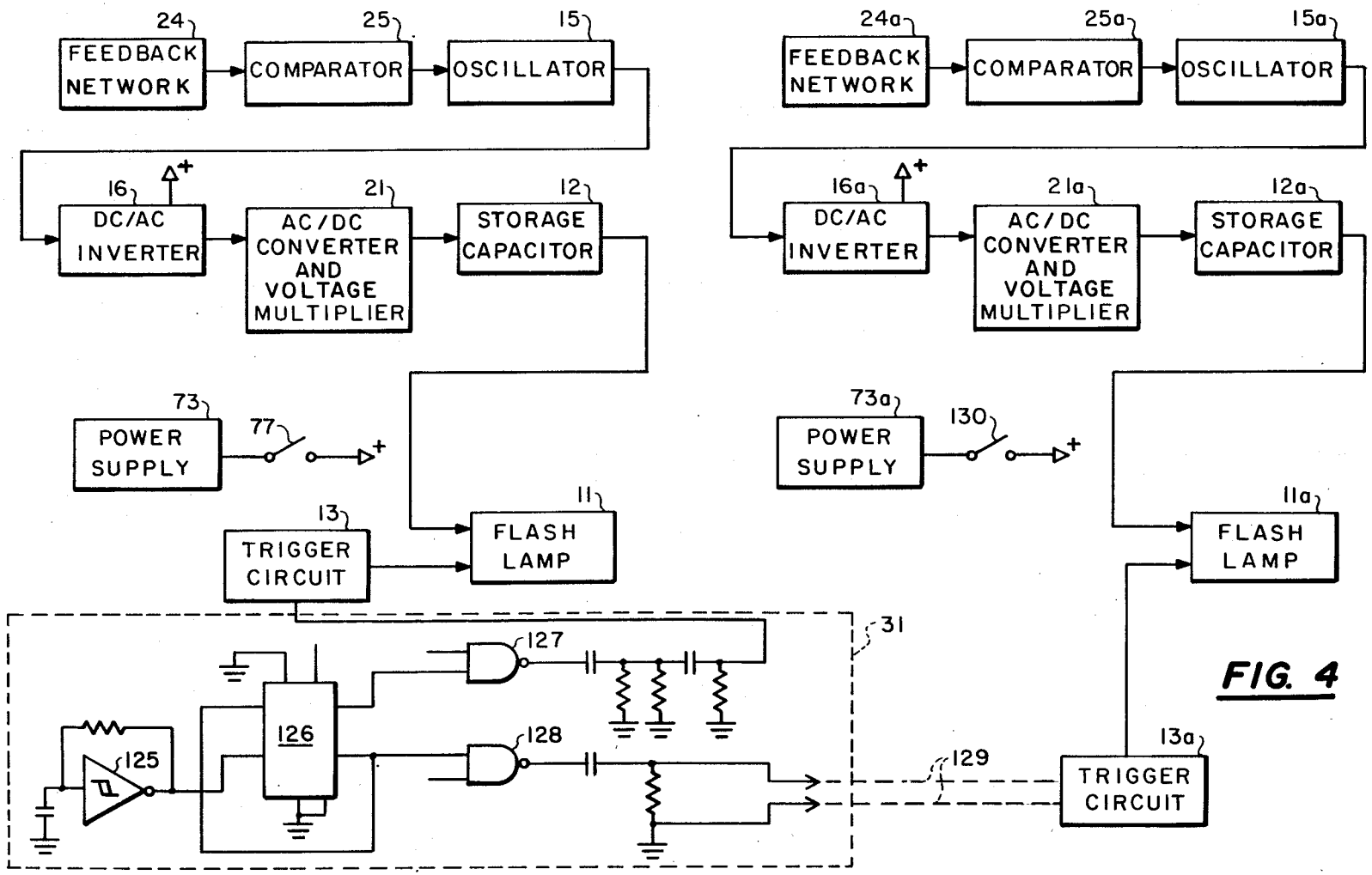
FIG. 4 is a schematic diagram of the generator of FIG. 1 configured for a dual alternating flash emergency unit.

The circuit of FIG. 4 is for a dual-flash emergency signal unit and comprises two identical charging and flashing circuits which are interconnected so that they are commonly actuated. Further, it is normally desired to have the flashes of this device occur in alternating fashion as opposed to simultaneously, so that one flash lamp will discharge followed by the other in indefinite sequence. The left side of the circuitry in FIG. 4 is termed the "master unit" and the right side is the "slave unit". The basic elements set forth in the block diagram of FIG. 1 and in the circuit diagram of FIG. 2 are substantially identical in each unit of FIG. 4. The circuit elements of the slave unit on the right side of FIG. 4 which are the same as those in the master are designated by the subscript "a".

The trigger control circuit 31 comprises a Schmitt trigger 125 which controls a flip-flop 126, the output of which goes to gate elements 127 and 128. The output of gate 127 controls trigger circuit 13 of the master unit and the output of gate 128, through a pair of conductive telescoping rods 129, controls the trigger circuit **13*a* of the slave unit. In the stored condition rods 129 are telescoped together, on/off switches 77, 130 in power supplies 73, 73*a* are open the master and slave flash units are closely adjacent. When deployed, the units are pulled apart to extend the rods and on/off switches 77 and 130 are closed to charge the storage capacitor and commence operation of the signals. The signal unit may be so configured that the act of pulling the master and slave units apart automatically closes switches 77 and 130**.

The charge time of each storage capacitor of the dual emergency unit of FIG. 4 is substantially the same as the units discussed previously, that is, about one second. It is anticipated that the flashes will occur at intervals which are equal to or greater than one second so the charging circuit operates in the same manner as previously described. Thus the charging function will occur within about one second and the feedback network and comparator will function to stop the oscillator and thereby the charging of the capacitor. When this unit is operating normally, it is anticipated that little or no leakage will occur in the capacitor in the few moments between flashing intervals. However, even if such leakage should occur, the system will function just as described with respect to the previous embodiment and the charge will be maintained within a very few volts, approximately one percent. Of course, the charging time could be reduced, the flash frequency decreased, or any other similar changes could be made.

Figure 5:
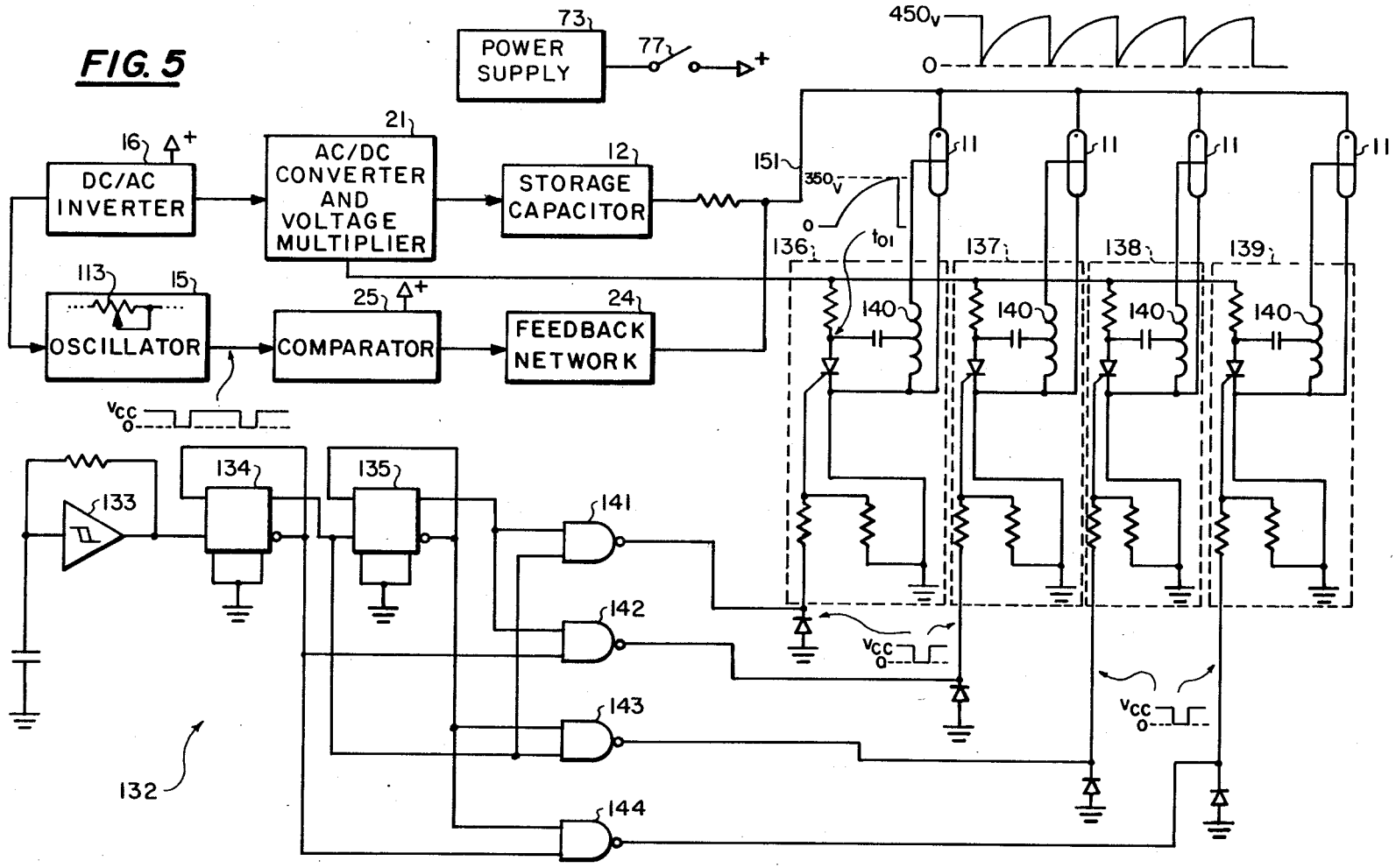
FIG. 5 is a schematic diagram of the generator of FIG. 1 configured to operate as a sequential four-flash emergency unit.

The circuit of FIG. 5 is also designed for an emergancy unit, this circuit providing four discreet flashes in sequence. The purpose for sequential flashes is not only to attract attention but to possibly spell out a word where the flashes are positioned behind transparent or translucent sheets having contrasting letters or numerals in the faces thereof. Additionally, the sequence could be such as to create an arrow effect.

Feedback network 24 and comparator 25 are substantially identical with the embodiments previously described. Oscillator 15 includes an adjustable resistor 131 to vary the duty cycle of the oscillator. The power supply 73 coupled to inverter 16 through on/off switch 77 is the same as before. Likewise, converter/multiplier 21 and storage capacitor 12 are as previously described.

The basic differences in the FIG. 5 voltage generator are centered around the fact that there are four flash tubes 11 and four trigger circuits 136–139 controlled by trigger control circuit 132. Each combination of trigger circuit and flash tube is substantially the same as previously described. However, the tubes flash in sequence pursuant to signals applied from the trigger circuits due to the sequential control of trigger control 132. Circuit 132 comprises a Schmitt trigger oscillator circuit 133 feeding toggling flip-flops 134 and 135 which in turn control the sequential operation of NAND gates 141, 142, 143 and 144. The outputs of each of these NAND gates controls the appropriate trigger circuit. Note that the trigger signal applied to the gate of each SCR in the trigger circuits is at a constant positive voltage $V_{cc}$ which goes to zero for a short time and at time $t_o$ it returns to the $V_{cc}$ level. The primary reason for maintaining the positive voltage on the SCR gates is to keep the SCR conducting and make the flash tube circuits non-responsive to noise pulses which may occur in the circuitry. When an SCR conducts, a short duration voltage spike of about 4000 volts is applied to the flash tube through coil 140, causing the very short duration but brilliant flash.

Figure 6:
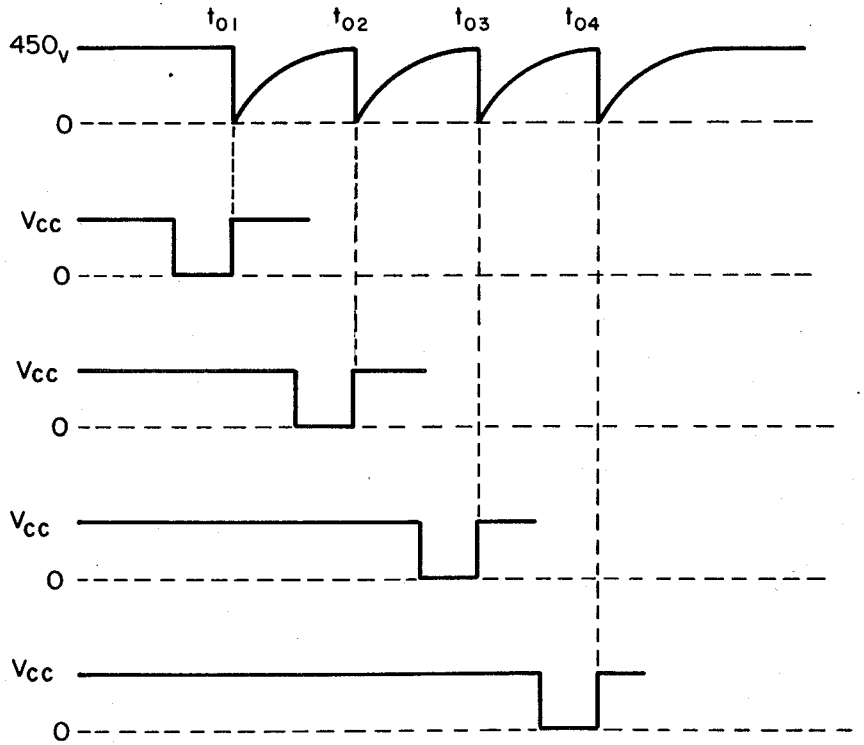
FIG. 6 shows the timing waveforms for triggering the generator of FIG. 5.

When the unit of FIG. 5 is actuated by closing on/off switch 77, within about one second or less, power supply 73 has charged storage capacitor 12 which is coupled across each of flash tubes 11. Pursuant to the sequential operation of trigger control 132, trigger circuits 136, 137, 138 nd 139 fire the flash tubes in sequence. The waveform diagram of FIG. 6 shows the voltage on line 151 as it behaves through one cycle of four flashes, in relation to the trigger signal applied to the gate of each SCR in sequence. Time $t_{o1}$ is the instant of triggering the first flash lamp, $t_{o2}$ is the instant of triggering the second flash lamp, and so on.

In order to conserve power and make the circuit as efficient as possible, only one power supply and one storage capacitor 12 are used for the four-flash unit of FIG. 5. As each tube is flashed, the oscillator functions to recharge the storage capacitor. Each flash tube is triggered after the storage capacitor has reached full charge, at approximately one second intervals. As in the other embodiments. when storage capacitor 12 achieves full charge of approximately 450 volts DC, the charging circuit is shifted to a quiescent condition because of feedback network 24 and comparator 25.

In view of the above description, it is likely that improvements and modifications will occur to those skilled in the art which are within the scope of the accompanying claims.

What is claimed is:

1. A controlled high voltage generator comprising:
flash lamp means;
storage capacitor means connected across said flash lamp means;
means connected to said flash lamp means for triggering said flash lamp means into conduction;
a DC power source;
an enable switch through which said power source is coupled to said high voltage generator
oscillator means coupled to said source of DC power;
a DC/AC inverter connected to the output of said oscillator means and to said DC power source;
an AC/DC converter and voltage multiplier connected between said DC/AC inverter and said storage capacitor means to charge said storage capacitor means to a desired voltage level;
a feedback network;
comparator means connected between said feedback network and said oscillator; and
means for coupling the voltage level of said storage capacitor means output from said voltage multiplier to said feedback network, said comparator means actuating said oscillator means when a predetermined reduction in the voltage on said storage capacitor means below the desired voltage level is detected, and disabling said oscillator means when the desired voltage level on said storage capacitor means is achieved;
whereby such storage capacitor means is charged to and maintained substantially at the a desired voltage level sufficient to actuate said flash lamp means as desired at a predetermined output level only when said enable switch is closed.

2. The voltage generator recited in claim 1 wherein said triggering means comprises a trigger circuit connected between said flash lamp and said source of DC power.

3. The voltage generator recited in claim 1 wherein said oscillator operates at about 25 KHz.

4. The voltage generator recited in claim 1 wherein said DC/AC inverter has an AC output amplified 10 to 15 times above the voltage value of said DC power source input.

5. The voltage generator recited in claim 4 wherein said AC/DC converter converts said AC signal to DC and said voltage multiplier amplifies the voltage input to a level of about 450 volts.

6. The voltage generator recited in claim 1 wherein said feedback network comprises a variable resistor adapted to adjust the voltage level at which said comparator triggers said oscillator into oscillation.

7. The voltage generator recited in claim 1 wherein said comparator comprises a Schmitt trigger.

8. The voltage generator recited in claim 1 wherein said DC/AC inverter comprises a field effect transistor (FET), the conduction of which is controlled by the output of said oscillator.

9. The voltage generator recited in claim 8 wherein said DC power is applied to said DC/AC inverter through one end of a coil having a tap intermediate its ends, said FET being connected to said tap, the other end of said coil being connected to said AC/DC converter.

10. The voltage generator recited in claim 1 and further comprising a sound circuit adapted to emit a sound substantially simultaneously with the flash of said flash lamp.

11. The voltage generator recited in claim 10 wherein said sound circuit comprises a speaker powered by an audio driver.

12. The voltage generator recited in claim 1 wherein the predetermined reduction in the level of the voltage on said storage capacitor is about 1% of the desired level.

13. The voltage generator recited in claim 1 and further comprising a second high voltage generator comprising:
a second flash lamp;
a second storge capacitor connected across said second flash lamp;
second means connected to said second flash lamp for triggering said second flash lamp into conduction;
a second DC power source;
a second oscillator coupled to said second source of DC power;
a second DC/AC inverter connected to the output of said second oscillator and to said second DC power source;
a second AC/DC converter and voltage multiplier connected between said second DC/AC inverter and said second storage capacitor;
a second feedback network;
a second comparator connected between said second feedback network and said second oscillator; and
second means for coupling the voltage output from said second voltage multiplier to said second feedback network, said second comparator actuating said second oscillator when a predetermined reduction in the voltage on said second storage capacitor is detected;

trigger control means coupled to said respective triggering means of said high voltage generator and said second high voltage generator;

whereby said trigger control means causes said flash lamp and said second flash lamp to flash in regular and continuous alternating sequence.

14. The voltage generator recited in claim 1 wherein:

said flash lamp means comprises a plurality of flash lamps connected in parallel;

said triggering means comprises a like plurality of trigger circuits connected to respective said flash lamps, each said flash lamp and triggering means combination being connected to function independently of each other such combination;

said generator further comprising trigger control means connected individually to said trigger circuits, said trigger control means being configured to actuate said flash lamps through said triggering means in a predetermined repetitive sequence.

15. A method for repeatedly generating a controlled high voltage for firing flash lamp means, said method comprising the steps of:

applying a low DC voltage to a DC/AC inverter having a field effect transistor (FET) control means;

switching said FET on and off by oscillator means at a predetermined frequency to provide an amplified AC signal at the output of said inverter;

amplifying the AC voltage to a high level of about fifty times the value of said low DC voltage applied to said inverter;

converting said highly amplified voltage to a DC voltage;

applying the highly amplified voltage to a storage capacitor connected across the flash lamp;

feeding back the output voltage applied to the storage capacitor to a feedback network and comparator; and controlling the operation of the oscillator means by the comparator so that whenever the voltage on the storage capacitor is below a predetermined level, the comparator provides a signal to actuate the oscillator means to recharge the capacitor.

16. The method recited in claim 15 wherein the DC/AC inverter amplifies the low DC voltage to an AC voltage 10 to 15 times the value of the DC voltage.

17. The method recited in claim 15 wherein the DC voltage applied to the storage capacitor is about 450 volts.

18. The method recited in claim 15 wherein the comparator actuates the oscillator when the voltage on said storage capacitor reduces about 1% below the predetermined level.

19. A controlled high voltage generator comprising:

flash lamp means;

storage capacitor means connected across said flash lamp means;

means connected to said flash lamp means for triggering said flash lamp means into conduction;

a DC power source;

an enable switch through which said power source is coupled to said high voltage generator;

oscillator means coupled to said source of DC power;

means coupled between said oscillator means and said storage capacitor means for charging said storage capacitor means to a predetermined voltage level sufficient to fire said flash lamp means; and feedback network means comprising:

comparator means coupled to said storage capacitor means for sensing the level of voltage thereon;

said oscillator; and said charging means, said comparator means actuating said oscillator means when the voltage on said storage capacitor means is below a predetermined level;

whereby said storage capacitor means is charged to and maintained substantially at a desired voltage level sufficient to actuate said flash lamp means at a predetermined output level only when said enable switch is closed.

20. The voltage generator recited in claim 19, wherein said triggering means comprises a trigger circuit connected between said flash lamp and said source of DC power.

21. The voltage generator recited in claim 19, wherein said feedback network further comprises a variable resistor adapted to adjust the voltage level at which said comparator means triggers said oscillator into oscillation.

22. The voltage generator recited in claim 19, wherein said comparator means comprises a Schmitt trigger.

23. The voltage generator recited in claim 19, and further comprising a sound circuit adapted to emit a sound substantially simultaneously with the flash of said flash lamp.

24. The voltage generator recited in claim 19, wherein the predetermined level of the voltage on said storage capacitor is about 1% of the desired level.

25. A method for repeatedly generating a controlled high DC voltage for firing flash lamp means, said method comprising the steps of:

closing enabling switch means;

selectively providing oscillations at a predetermined frequency by means of an oscillator;

converting low DC voltage to the controlled high voltage by circuit means energized by said oscillations;

applying the controlled high voltage to storage capacitor means connected across the flash lamp means, thereby charging said storage capacitor means to a desired level;

sensing the voltage level on said storage capacitor means by comparator means, said comparator means providing on and off control to said oscillator;

feeding back the voltage level on said storage capacitor means to said comparator means, the feedback loop comprising said oscillator, said comparator means and said converting circuit means; and recharging said storage capacitor means to said desired level whenever the voltage level thereon is sensed by said comparator means to be below a predetermined level less than the desired level, said recharging step occurring only when said enabling switch is closed.

26. The method recited in claim 25, wherein said comparator means actuates said oscillator when the voltage on said storage capacitor means reduces about 1% below the desired level.

* * * * *